US007198531B2

(12) United States Patent
Nakamura et al.

(10) Patent No.: US 7,198,531 B2
(45) Date of Patent: Apr. 3, 2007

(54) DRIVE SHAFT SUPPORTING STRUCTURE FOR JET PROPULSION WATERCRAFT

(75) Inventors: Mitsuyoshi Nakamura, Hamamatsu (JP); Yasuhiko Henmi, Hamamatsu (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 10/972,761

(22) Filed: Oct. 25, 2004

(65) Prior Publication Data

US 2005/0124236 A1 Jun. 9, 2005

(30) Foreign Application Priority Data

Oct. 24, 2003 (JP) ..... 2003-364645

(51) Int. Cl.
*B63H 23/34* (2006.01)

(52) U.S. Cl. ..... 440/83; 440/52

(58) Field of Classification Search ..... 440/83, 440/52

See application file for complete search history.

(56) References Cited

U.S. PATENT DOCUMENTS

| | | | | |
|---|---|---|---|---|
| 1,267,117 | A | | 5/1918 | Riotte |
| 2,636,790 | A | * | 4/1953 | McNally ..... 384/99 |
| 2,769,420 | A | | 11/1956 | Horton et al. |
| 2,866,670 | A | | 12/1958 | Harris |
| 3,014,768 | A | | 12/1961 | Dickinson |
| 3,625,523 | A | | 12/1971 | Gardner |
| 3,839,859 | A | | 10/1974 | Woell, Jr. |
| 3,970,398 | A | | 7/1976 | Wilson |
| 4,073,257 | A | | 2/1978 | Rodler, Jr. |
| 4,395,141 | A | | 7/1983 | Pietsch et al. |
| 4,541,808 | A | | 9/1985 | Ono et al. |
| 4,632,403 | A | | 12/1986 | Ishitani et al. |
| 4,722,707 | A | | 2/1988 | Murase |

(Continued)

FOREIGN PATENT DOCUMENTS

JP 53-21197 6/1978

(Continued)

OTHER PUBLICATIONS

1999 Bombardier Sea Doo Shop Manual vol. 1, pp. 9-03-1 to 9-03-15.

(Continued)

*Primary Examiner*—Ed Swinehart
(74) *Attorney, Agent, or Firm*—Knobbe Martens Olson & Bear LLP

(57) ABSTRACT

A drive shaft supporting structure for a watercraft is provided that supports in a substantially watertight manner at least a portion of the driveshaft. The drive shaft extends from an engine, which is disposed within an inner section of a hull of the watercraft (e.g., an engine compartment), to a propulsion unit that is disposed outside the inner section of the hull. The driveshaft supporting structure includes a bearing part that is mounted on a peripheral surface of the driveshaft at a location within the inner section of the hull. An elastic part is mounted on a peripheral surface of the bearing part and a bearing part supporting section supports a press-fitted assembly of the elastic part and the bearing part. The bearing part supporting section is attached to a wall of the hull (e.g., a duct wall) at a location where the driveshaft extends from the inner section of the hull.

12 Claims, 8 Drawing Sheets

U.S. PATENT DOCUMENTS

| | | | | |
|---|---|---|---|---|
| 4,872,531 | A | 10/1989 | Meisenburg et al. | |
| 4,902,254 | A | 2/1990 | Chas | |
| 4,971,584 | A | 11/1990 | Inoue et al. | |
| 5,030,149 | A | 7/1991 | Fujita | |
| 5,152,704 | A | 10/1992 | Carlson | |
| 5,209,497 | A | 5/1993 | Von Bergen et al. | |
| 5,372,526 | A | 12/1994 | Ozawa et al. | |
| 5,405,276 | A | 4/1995 | Kato | |
| 5,558,456 | A | 9/1996 | Nakase et al. | |
| 5,967,868 | A * | 10/1999 | Ito et al. | 440/111 |
| 6,296,394 | B1 * | 10/2001 | Braun et al. | 384/535 |

FOREIGN PATENT DOCUMENTS

| | | |
|---|---|---|
| JP | 55-059098 | 5/1980 |
| JP | 60-26179 | 8/1985 |
| JP | 61-67695 | 4/1986 |
| JP | 03-19797 | 2/1991 |
| JP | 06-048386 | 2/1994 |
| JP | 2003-89395 | 3/2003 |

OTHER PUBLICATIONS

1999 Bombardier Sea Doo Racing Handbook, p. 4-13.

2000 Bombardier Sea Doo Parts Catalog, p. C6.

2000 Bombardier Sea Doo Shop Manuel, vol. 1, pp. 9-03-1 to 9-03-14.

2004 Polaris Parts Manual, p. A-12.

* cited by examiner

DRIVE SHAFT SUPPORTING STRUCTURE FOR JET PROPULSION WATERCRAFT

RELATED APPLICATIONS

The present application is based on and claims priority under 35 U.S.C. § 119 to Japanese Patent Application Nos. 2003-364645 (filed on Oct. 24, 2003), the disclosure of which is hereby incorporated by reference in its entirety.

BACKGROUND OF THE INVENTION

1. Field of the Invention

The present invention generally relates to a driveshaft supporting structure for a watercraft. More particularly, the present invention relates to a driveshaft supporting structure for supporting a driveshaft extending from an engine disposed inside the body of the watercraft to a propulsion unit disposed generally outside the body of the watercraft.

2. Description of the Related Art

Conventional jet propulsion watercraft run on water by driving a propulsion unit to aspirate water from the bottom of the body of the watercraft and emit the water rearward from the stern. In such a jet propulsion watercraft, a driveshaft extends from an engine located within an inner section of the watercraft body to the propulsion unit located within an outer section of the watercraft body to transmit the driving force of the engine to the propulsion unit. The driveshaft passes through an opening in a duct formed integrally with a hull composing the lower part of the body, and extends to the outer section of the body. The driveshaft within the inner section of the body is supported by a driveshaft supporting structure secured to the duct.

In the driveshaft supporting structure, a bearing part is provided on the outer peripheral surface of the driveshaft and a cylindrical elastic part made of rubber extends rearward from the outer peripheral surface of the bearing part. A cylindrical rubber joint, joined to the rear end of the cylindrical elastic part, is joined to the duct and surrounds the driveshaft. An annular reinforcement member is provided on the outer peripheral surface of the cylindrical elastic part, and the reinforcement member is joined via a base to a bearing part supporting section that is secured to the duct. Thus, the bearing part supporting section is secured to the duct in such a manner as to surround the cylindrical elastic part and the joint rubber.

However, in the aforementioned driveshaft supporting structure, the size of the bearing part supporting section is large owing to its construction, and thus the vacant space is small in the vicinity of the driveshaft supporting structure within the inner section of the body. This leads to a problem that the vacant space for installing other parts is small and the parts layout flexibility is restricted. Another problem is that complex work is required to secure the cylindrical elastic part to the duct via the rubber joint, and that installing the driveshaft supporting structure is bothersome because of the large number of the components. A further problem is that baking, the process generally used for securing the cylindrical elastic part and the reinforcement member, requires additional production cost.

Therefore, a need exists for a driveshaft supporting mechanism for a jet propulsion watercraft that is compact and requires less installation space, that facilitates the installation work, and that reduces the production cost of the driveshaft supporting mechanism.

SUMMARY OF THE INVENTION

One aspect of the present invention involves a driveshaft supporting structure for a watercraft that supports in a substantially watertight manner at least a portion of a driveshaft. The extends from an engine, which is disposed within an inner section of a hull of the watercraft (e.g., an engine compartment), to a propulsion unit that is disposed outside the inner section of the hull. The driveshaft supporting structure includes a bearing part that is mounted on a peripheral surface of the driveshaft at a location within the inner section of the hull. An elastic part is mounted on a peripheral surface of the bearing part and a bearing part supporting section supports a press-fitted assembly of the elastic part and the bearing part. The bearing part supporting section is attached to a wall of the hull (e.g., a duct wall) at a location where the driveshaft extends from the inner section of the hull.

In a preferred mode of the invention, the driveshaft supporting structure supports a forward portion of an impeller shaft, which forms a portion of the driveshaft.

In accordance with another aspect of the present invention, a watercraft is provided that comprises a hull, an engine disposed within the hull, and a propulsion device that is carried by the hull. At least one wall of the hull is disposed between the engine and the propulsion device. A driveshaft extends between the engine and the propulsion device so as to transfer power from the engine to the propulsion device. The driveshaft extends through the wall of the hull. A driveshaft supporting device is attached to the wall and comprises a bearing part mounted on a peripheral surface of the driveshaft. The bearing part is disposed on an engine-side of the wall. An elastic part is mounted on a peripheral surface of the bearing part, and a bearing part supporting section supports the elastic part that is press-fitted with the bearing part. The bearing part supporting section is attached to the wall at a location where the driveshaft extends through the wall.

In accordance with another aspect of the present invention, a press-contact surface is provided at a front end of the elastic part securing section to allow the elastic part to be press-fitted with a rear side thereof. When the elastic part is press-fitted with the elastic part supporting section and the elastic part securing section composed of the bearing part supporting section, deformation of the front end face of the elastic part is restrained by the press-contact surface, allowing the elastic part to be press-fitted, providing a more reliable seal.

In accordance with an additional aspect of the present invention, the elastic part supporting section and the elastic part securing section of the bearing part supporting section are fastened with a bolt or suitable fastener. Accordingly, the assembly work needed to fasten the bearing part and the bearing part supporting section together, while press-fitting the elastic part, is reduced.

In accordance with yet another aspect of the present invention, a front end of the elastic part is positioned at a front end surface of the bearing part, and the front end of the elastic part is secured by the front end surface of the bearing part and the press-contact surface. A more reliable seal is provided between the bearing part and the elastic part, and between the elastic part and the press-contact surface, to provide an improved sealing ability of the driveshaft supporting structure.

In accordance with still another aspect of the present invention, the bearing part supporting section comprises a ring-shaped mounting part surrounding an outer peripheral surface of the elastic part to support the elastic part, and a supporting part body secured to the duct to support a side surface of the mounting part, where the elastic part is secured by clamping a portion thereof between the mounting part and the supporting part body. A substantially watertight structure is thus obtained at a reduced cost because the elastic part is secured to the mounting part by clamping a portion of the elastic part between the mounting part and the supporting part body.

In accordance with another aspect of the present invention, the bearing part supporting section has an annular part surrounding an outer peripheral surface of the elastic part that supports the elastic part, and an integral unit made up of the bearing part and the elastic part is press-fitted into the annular part for assembly. The press contact of the elastic part can be achieved, and a substantially watertight structure can be obtained at the same time. With this design, the amount of assembly work needed is reduced and the construction is simplified.

BRIEF DESCRIPTION OF THE DRAWINGS

These and other features, aspects and advantages of the present invention are described in detail below with reference to the accompanying drawings of preferred embodiments, which are intended to illustrate and not to limit the present inventions. The drawings comprise eleven figure, which are briefly described as follows.

DETAILED DESCRIPTION OF THE PREFERRED EMBODIMENT

Figure 1:
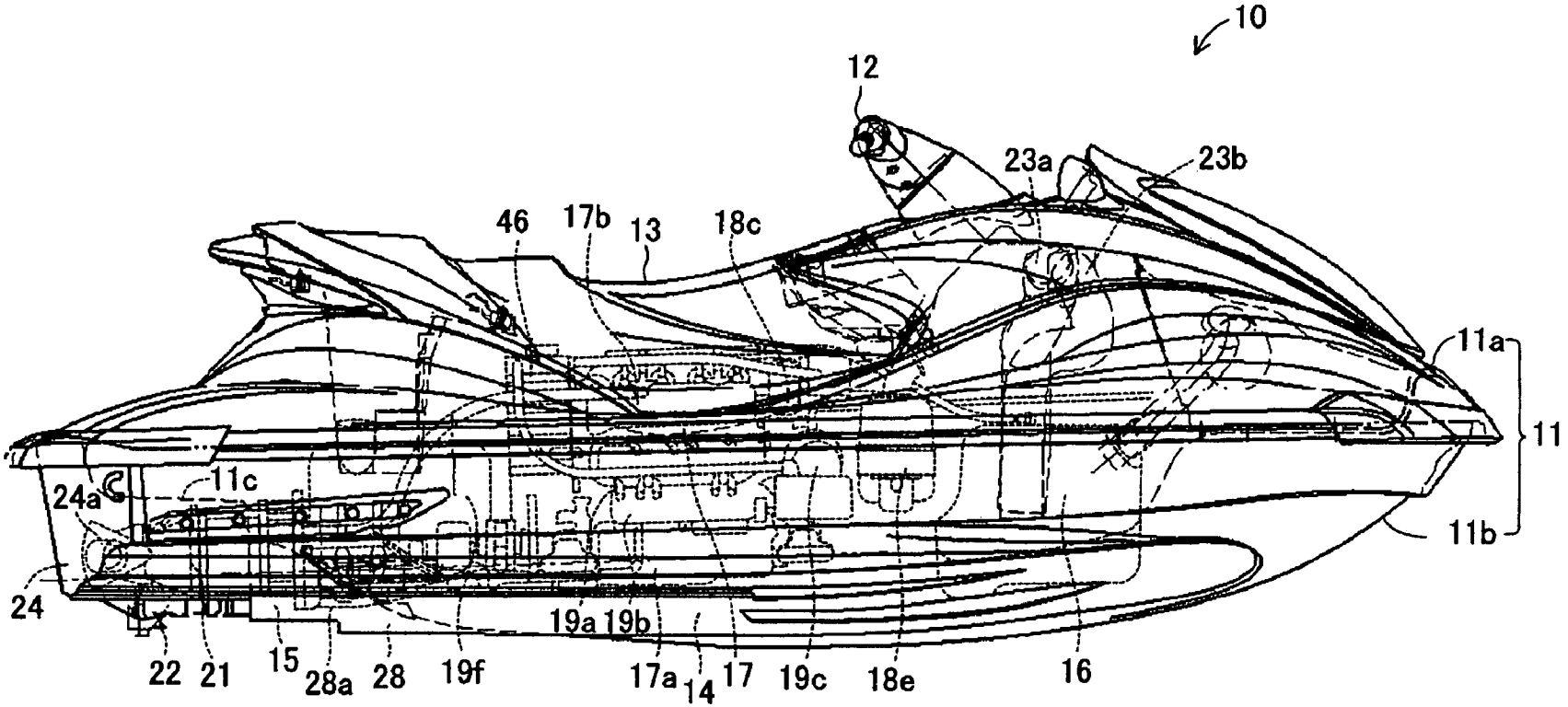
FIG. 1 is a side view of a jet propulsion watercraft having a driveshaft supporting mechanism according to a first embodiment, and showing some of the internal components of the watercraft (in phantom).
Figure 2:
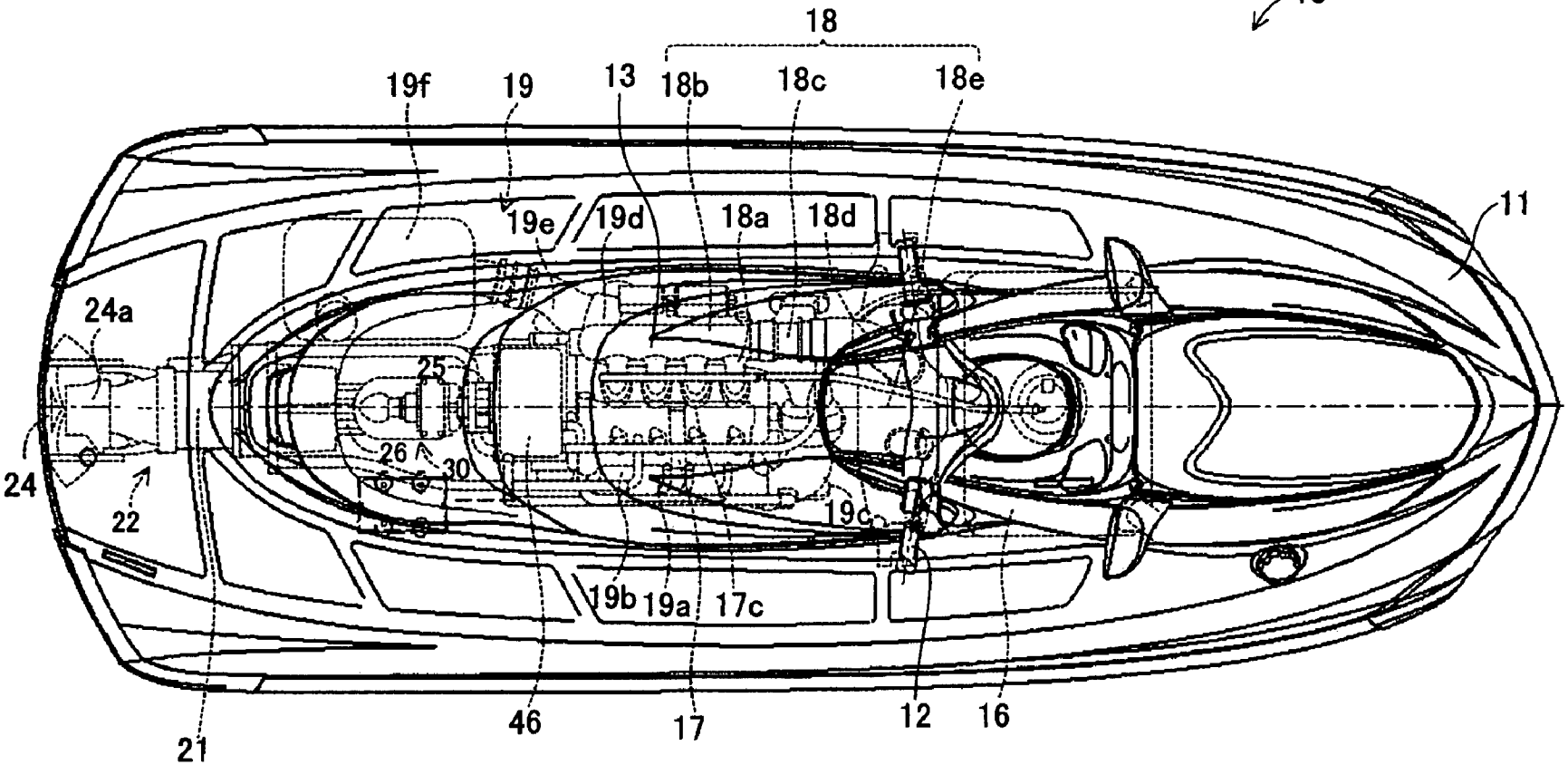
FIG. 2 is a top view of the watercraft of FIG. 1, showing some of the internal components of the watercraft (in phantom).

FIG. 1 and FIG. 2 show a jet propulsion watercraft 10 having a driveshaft supporting structure 30, according to a first embodiment. The jet propulsion watercraft 10 has a body or hull 11 that includes a deck 11*a* on an upper part of the body 11 and a hull 11*b* on a lower part of the body 11. The hull 11 can additionally include one or more internal walls, bulkheads or structures that increase the rigidity of the hull, define separate compartments or ducts, or that support internal components of the watercraft 10. Steering handlebars 12 are positioned generally in the center of the upper part of the body 11, and a seat 13 is positioned rearward of the steering handlebars 12. The watercraft body 11 defines an engine chamber 14 in the front section of the body 11, and defines a pump chamber 15 that communicates with the outside of the watercraft 10 in the rear section of the body 11. The engine chamber 14 houses, among other components, a fuel tank 16, an engine 17, an air intake system 18, and an exhaust system 19. The pump chamber 15 houses, among other components, a propulsion unit 22, including a jet pump 21.

Air ducts 23*a* and 23*b* are provided within the engine chamber 14 on both sides of the chamber 14. The air ducts 23*a*, 23*b* introduce ambient air into the engine chamber 14. The air ducts 23*a* and 23*b* extend generally vertically from the upper part of the body 11 to a location generally near the bottom of the engine chamber 14, and are configured to draw in the air from outside the watercraft through an upper end of the ducts 23*a*, 23*b* by way of a waterproof structure (not shown) provided on the deck 11*a*. The air ducts 23*a*, 23*b* direct the air into the engine chamber 14 through a bottom end of the ducts 23*a*, 23*b*.

The fuel tank 16, which stores fuel, is generally disposed in the lower front part of the watercraft body 11, and the engine 17 is disposed in the bottom of the body 11, generally near the center of the watercraft 10. In one embodiment, the engine 17 is a water-cooled, 4-stroke engine having 4 in-line cylinders, with an outer shell of the engine 17 composed of a cylinder body 17*a* that houses a crankshaft (not shown) and a cylinder head 17*b* formed on top of the cylinder body 17*a*.

Pistons (not shown) of the engine 17 are joined to the crankshaft via connecting rods (not shown). In a preferred embodiment, the pistons are slidably inserted in a generally vertical direction within the cylinder body 17*a*. The generally vertical sliding motion of the pistons is transferred to the crankshaft and converted into a rotational motion.

Each cylinder column 17*c*, formed in part by the cylinder body 17*a* and the cylinder head 17*b* has an intake valve and an exhaust valve. An intake port that communicates with the intake valve connected to the intake system 18, while an exhaust port communicates with the exhaust valve connected to the exhaust system 19. The intake valve opens during an intake stroke, allowing a mixture of air from the intake system 18 and fuel from the fuel system (not shown) to flow into the cylinder head 17*b*. The intake valve closes during an exhaust stroke. The exhaust valve opens during the exhaust stroke to allow combustion gases to exit the cylinder head 17*b* via the exhaust port into the exhaust system 19.

In the illustrated embodiment, the intake system 18 includes an intake pipe 18*a* respectively connected to the intake port of each cylinder column 17*c*, an intake manifold 18*b* connected to an upstream end of each intake pipe 18*a*, a throttle body 18*c* connected to an upstream end of the intake manifold 18*b*, and an air intake box 18*e* connected to the throttle body 18*c* via an air duct 18*d*. The air intake box 18*e* is preferably positioned between the engine 17 and the fuel tank 16 and is configured to aspirate the air drawn into the watercraft body 11 via the air ducts 23*a*, 23*b* and direct the air into the throttle body 18*c* via the air duct 18*d*.

The throttle body 18*c* has a throttle valve (not shown) that is preferably rotatable or pivotal with a horizontal pivot shaft. The throttle valve adjusts the flow rate of the air delivered into each cylinder column 17*c* by opening and closing an intake passage in the throttle body 18*c* in accordance with the rotation or pivoting of the horizontal pivot shaft. In a preferred embodiment, the intake manifold 18*b* is preferably made of resin or an aluminum alloy tubing that connects to the rear end of the throttle body 18*c* and is disposed along the upper part of a port side face of the engine 17. Similarly, each intake pipe 18*a* is preferably made of resin tubing that connects to the intake manifold

18*b*, with a downstream end of the intake pipe 18*a* joined to the intake port of each cylinder column 17*c*.

The engine 17 is supplied with fuel from the fuel tank 16 via the fuel system. The air-fuel mixture is preferably delivered into each cylinder column 17*c* in a generally uniform state by means of the intake pipe 18*a*.

The fuel system preferably includes, among other components, a fuel pump and at least one fuel injector. The fuel supplied from the fuel tank 16 via the fuel pump is preferably atomized by the fuel injector for injection into the cylinder column 17*c*. The fuel is mixed with the air supplied from the air intake box 18*e* through the intake pipe 18*a* to form the air-fuel mixture that is delivered into the cylinder column 17*c*.

The engine 17 preferably also has an ignition system. The air-fuel mixture combusts when it is ignited by the ignition system. Said combustion generates forces that move the pistons up-and-down, which in turn rotationally drives the crankshaft.

The exhaust system 19 preferably includes an exhaust pipe 19*a* connected to the exhaust port of each cylinder column 17*c*, a first muffler 19*b* connected to a downstream end of each exhaust pipe 19*a*, a ring joint 19*c* connected to a downstream end of the first muffler 19*b*, a second muffler 19*d* connected to a downstream end of the ring joint 19*c*, and a water lock 19*f* connected to a downstream end of the second muffler 19*d* via an exhaust hose 19*e*. In the illustrated embodiment, the exhaust pipe 19*a* extends obliquely downward from its upstream end, which connects to the exhaust port of the cylinder column 17*c*, while the downstream end of the exhaust pipe 19*a* connects to the first muffler 19*b*. The combustion gas emitted from each cylinder column 17*c* is preferably discharged into the first muffler 19*b* in a generally uniform state through the exhaust pipe 19*a*.

The first muffler 19*b* is disposed along the lower part of a starboard side face of the engine 17. The first muffler 19*b* is blocked at its rear end (i.e., upstream end), and a front end of the first muffler 19*b* extends to a position corresponding generally to the front end of the engine 17. The downstream end of the first muffler 19*b* connects to the ring joint 19*c*, which is preferably formed with a bend to change the direction of the flow by approximately 90 degrees. In the illustrated embodiment, the ring joint 19*c* extends obliquely upward as it bends along the corner of the engine 17, until the downstream end of the ring joint 19*c* reaches generally the center of the front face of the engine 17.

The second muffler 19*d* connects to the downstream end of the ring joint 19*c*, initially extending obliquely upward along the front face of the engine 17 and then extending rearward generally along the center of the port side face of the engine 17. Thus, at least a portion of the second muffler 19*d* is disposed below the intake manifold 18*b*. The downstream end of the second muffler 19*d* connects to the upstream end of the exhaust hose 19*e*, and the downstream end of the exhaust hose 19*e* is connected to the water lock 19*f*.

In the illustrated embodiment, the water lock 19*f* is a cylindrical tank to which a rearwardly extending exhaust gas pipe (not shown) connects at the rear top face of the tank. The upstream end of the exhaust gas pipe communicates with the water lock 19*f* on its top face. Preferably, the downstream part of the exhaust gas pipe initially extends upward and then downward toward the rear. The downstream end of the exhaust gas pipe preferably opens into a casing 11*c* to separate the propulsion unit 22 from the main part of the body 11.

Figure 3:
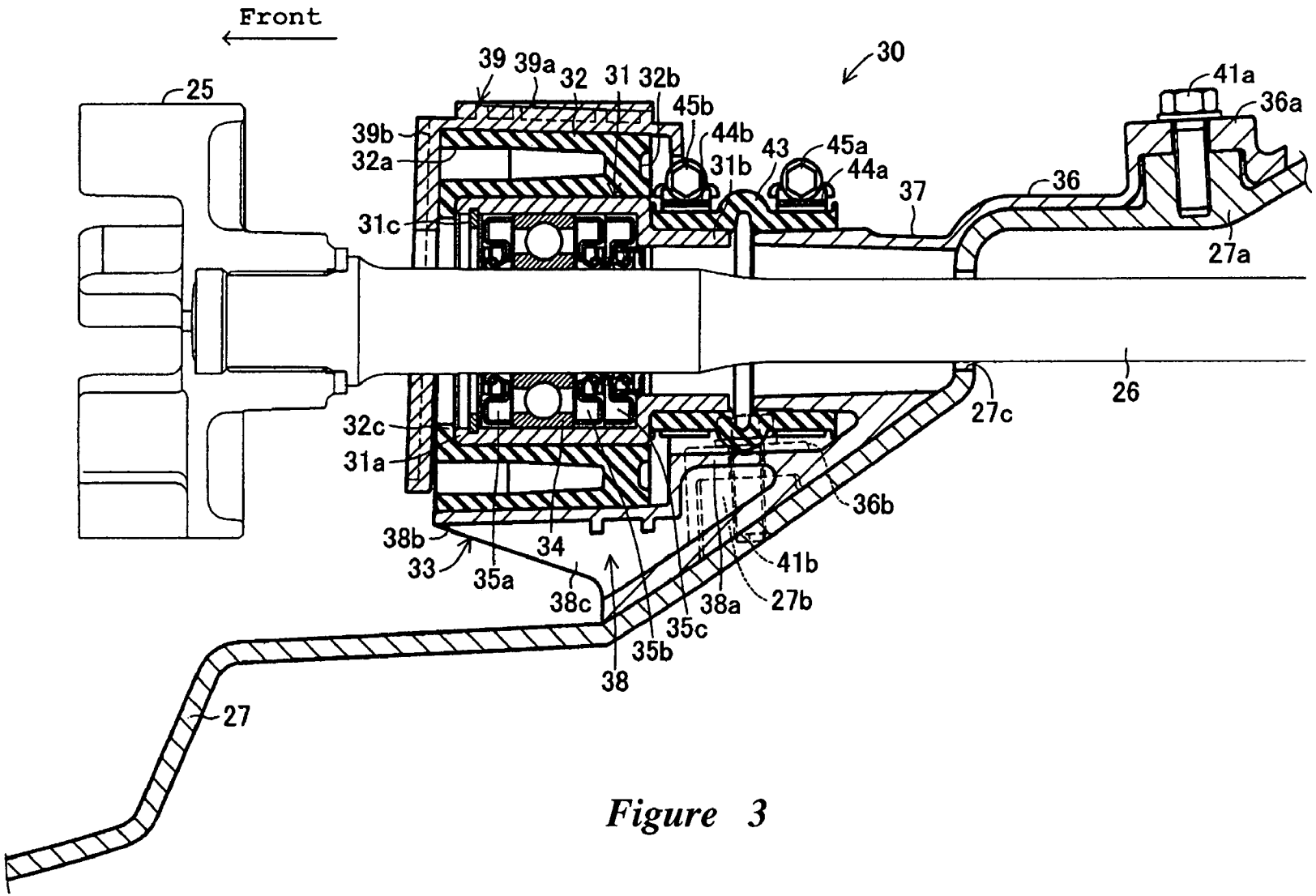
FIG. 3 is a cross-sectional view of the driveshaft supporting mechanism according to one embodiment.

An impeller shaft 26 preferably joins to the crankshaft via a coupling 25 that extends from the rear of the engine 17. The impeller shaft 26 passes through a duct that is formed in part by a front duct wall 27 of the hull 11. As best seen in FIG. 3, the front duct wall 27 is provided in this embodiment between the engine chamber 14 and the duct, which delivers water to the pump chamber 15 located near the aft end of the watercraft 10. The impeller shaft 26 preferably joins to an impeller provided within the propulsion unit 22. The propulsion unit 22 is preferably installed at the stem of the body 11. The impeller shaft 26 transmits the rotational force from the crankshaft that is generated by the operation of the engine 17 to the impeller in order to rotate the impeller. In the illustrated embodiment, the crankshaft, the coupling 25 and the impeller shaft 26 collectively make up a driveshaft; however, the driveshaft can include additional or few shaft sections. For example, a power-takeoff shaft can operate between the crankshaft and the coupling 25. Additionally, one or more transmissions can be provided between various shaft sections of the driveshaft, and various sections of the driveshaft can rotate about different rotational axes. For example, the rotational axis of the crankshaft can be oriented at an angle relative to the rotational axis of the impeller shaft 26, or the rotational axes of the crankshaft and the impeller shaft 26 can lie substantially parallel to each other with one located higher than the other relative to the bottom of the hull.

As shown in FIG. 2, the propulsion unit 22 includes a water inlet 28 having its opening located generally at the bottom of the watercraft body 11, and a water jet nozzle 24 with its opening located at the stem. Water introduced into the water inlet 28 is ejected through the water jet nozzle 24 by the rotation of the impeller, which generates thrust for the watercraft body 11. The propulsion unit 22 is disposed generally at the bottom at the stem of the body 11, separated from the main part of the body 11 by a casing 11*c* (part of the hull 11*b*) that divides the engine chamber 14 and the pump chamber 15. The impeller shaft 26 extends from the engine 17 to the propulsion unit 22, passing through the duct wall 27 provided on the casing 11*c*. Preferably, the water inlet 28 is provided with pipes 28*a* at certain intervals for preventing foreign matters from entering the propulsion unit 22. In other embodiments, other suitable mechanisms, such as filters or screens can be used to prevent foreign matter from entering the propulsion unit 22. The water jet nozzle 24 connects to a deflector 24*a* configured to selectively change the course of the watercraft body 11.

Figure 4:
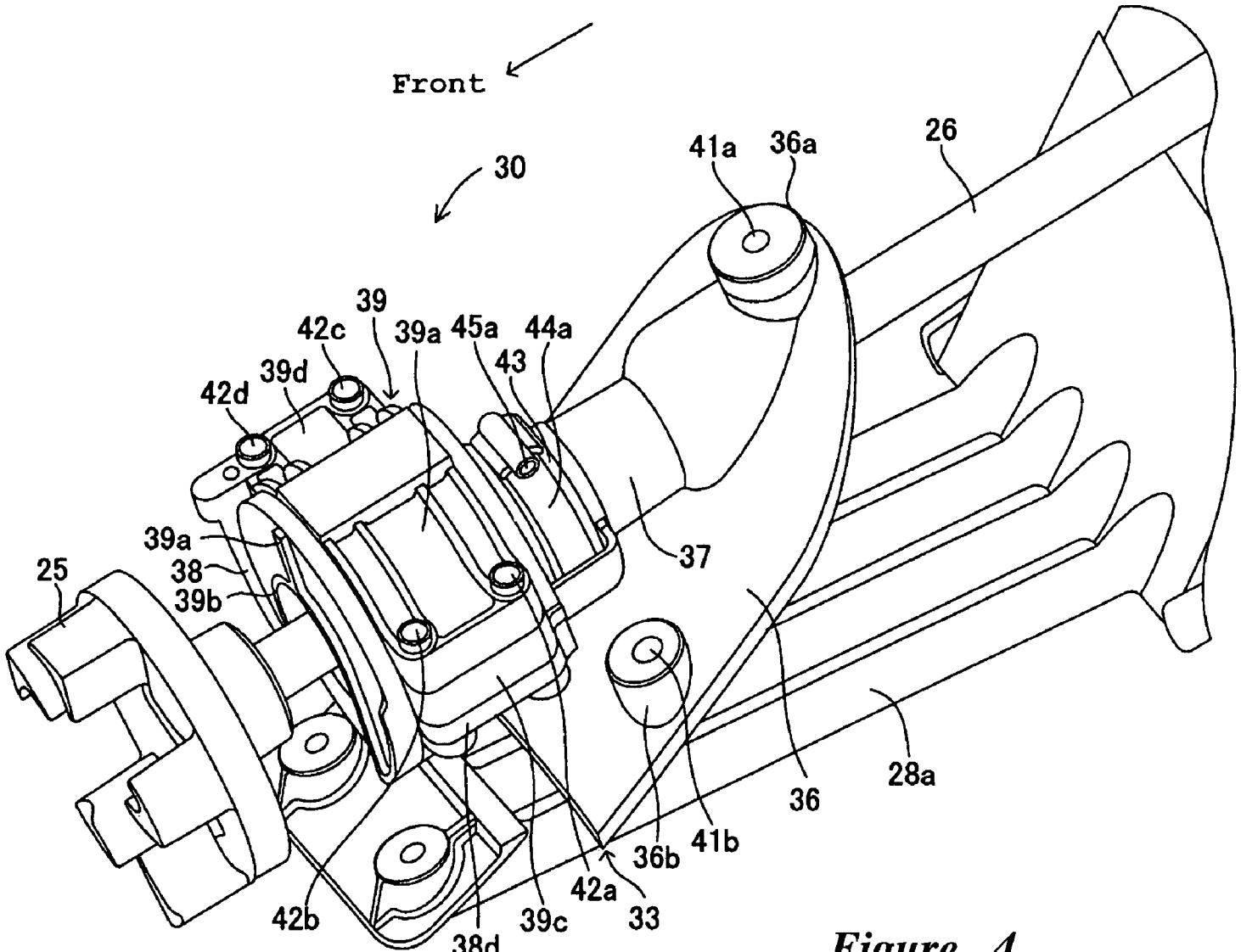
FIG. 4 is a top, side, and front perspective view of the driveshaft supporting mechanism shown in FIG. 3.

With reference to FIGS. 3–4, at least a part of the impeller shaft 26 disposed proximal the duct wall 27 within the engine chamber 14 is supported by a driveshaft supporting mechanism 30. In the illustrated embodiment, the driveshaft supporting mechanism 30 includes a bearing part 31 attached in a generally watertight manner to the outer surface of the impeller shaft 26, an elastic part 32 attached on the outer surface of the bearing part 31, and a bearing part supporting section 33 with a front portion attached to the outer surface of the elastic part 32 and a rear portion secured to the duct wall 27. In the illustrated embodiment, the bearing and elastic parts 31, 32 have a generally cylindrical shape. However, these components can have other suitable shapes, e.g., conical.

In the illustrated embodiment, an outer shell of the bearing part 31 preferably has a cylindrical housing part 31*a*, and a cylindrical projection 31*b* having a diameter smaller than the housing part 31*a* and projecting from the rear end of the housing part 31*a*. A bearing 34 is disposed generally at the center of the housing part 31*a*, an oil or grease seal part 35*a* is provided in front of the bearing 34 within the housing part 31*a*, and second and third grease seal parts 35*b*, 35*c* are provided side by side in the rear of the bearing 34 within the housing part 31*a*. The outer periphery of the rear face of the grease seal part 35*c* is preferably positioned so that it is press-fitted with a stepped portion formed at the boundary between the housing part 31*a* and the cylindrical projection 31*b*, while the outer periphery of the front face of the grease seal part 35*a* is positioned so that it is press-fitted with a ring-shaped engaging part 31*c* that engages a ring-shaped groove in the inner peripheral surface of the housing part 31*a* near the front end of the housing part 31*a*.

The elastic part 32 is preferably made of rubber and has a plurality of holes 32*a* at generally regular intervals about the circumference on the front end face of the elastic part 32. The rear end of each of the holes 32*a* extends toward the rear of the elastic part 32. In addition, a plurality of generally shallow holes 32*b* are provided at regular intervals about the circumference on the rear end face of the elastic part 32, and generally align with the holes 32*a*. A projection 32*c* that projects radially toward the center of the elastic part 32 is formed along the inner peripheral edge on the front end face of the elastic part 32, covering the front end face of the housing part 31*a*.

In a preferred embodiment, the bearing part supporting section 33 includes a base 36 secured to the duct wall 27, a cylindrical body 37 projecting forward from the base 36 and surrounding the impeller shaft 26, an elastic part supporting section 38 that extends forward from the lower part of the base 36 to support the lower part of the elastic part 32, and an elastic part securing section 39 assembled on top of the elastic part supporting section 38 to secure the elastic part 32 in conjunction with the elastic part supporting section 38. In the illustrated embodiment, the base 36 is plate-like; however, the base 36 can have other suitable shapes.

The base 36 preferably has a curved surface that generally conforms to the shape of the duct wall 27 and is attached to the duct wall 27 in a substantially watertight manner. Securing bosses 36*a*, 36*b* that face generally upward are provided in the rear and on both sides in the front (one of the bosses 36*b* is shown in FIG. 4), respectively, of the base 36. Also, securing bosses 27*a*, 27*b* are formed on the duct wall 27 at positions generally opposite to the bosses 36*a*, 36*b*. The base 36 is preferably attached along the surface of the duct wall 27 by mating the bosses 36*a*, 36*b* with the bosses 27*a*, 27*b* and then fastening the mated bosses with bolts 41*a*, 41*b*, or other suitable fasteners. While in the illustrated embodiment the base 36 overlies the duct wall 27 and does not form a section of the duct, the base 36 could be configured to attach to the duct wall 27 in a manner where a portion of the base 36 forms a forward section of the duct.

The cylindrical body 37 preferably projects forward from the base 36, with its front end extending proximal to the cylindrical projection 31*b* of the bearing part 31. The cylindrical body 37 and the cylindrical projection 31*b* preferably have generally the same diameter and are generally aligned together. As illustrated in FIG. 3, the elastic part supporting section 38 includes a joining part 38*a* that extends forward from the lower part of the base 36 a certain distance from the cylindrical body 37, a preferably semi-cylindrical supporting part 38*b* joined to the front end of the joining part 38*a* to support the elastic part 32, and a reinforcement part 38*c* to provide additional strength to the joining part 38*a* and the supporting part 38*b*. Securing pieces 38*d*, 38*e* (see FIG. 5) project outward from opposite edges of the supporting part 38*b*.

Figure 5:
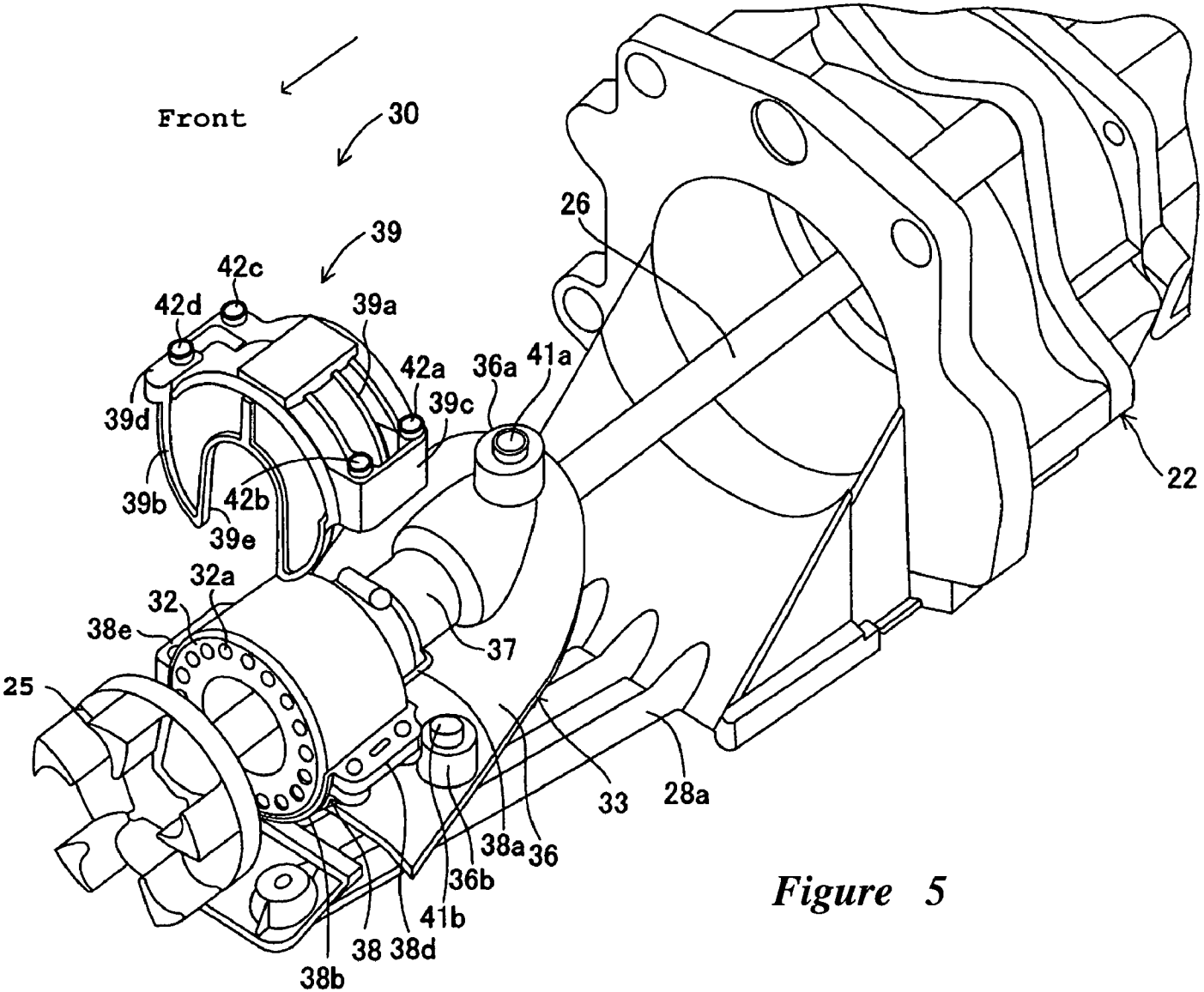
FIG. 5 is a partially exploded top, side and front perspective view of the driveshaft supporting mechanism shown in FIG. 4.

As shown in FIG. 5, the elastic part securing section 39 has a securing part 39*a* of generally the same shape as the supporting part 38*b* of the elastic part supporting section 38, and a press-contact surface 39*b* formed at the front end of the securing part 39*a*. The securing part 39*a* is generally formed in the shape of the supporting part 38*b* inverted upside down, and includes securing pieces 39*c*, 39*d* that project outward from opposite edges of the securing part 39*a*, wherein the securing pieces 39*c*, 39*d* of the securing part 39*a* are configured to align and mate with the securing pieces 38*d*, 38*e* of the supporting part 38*b*. The press-contact surface 39*b* preferably includes a generally C-shaped plate defining a recess 39*e* that allows the impeller shaft 26 to pass therethrough. Rearward pressure is applied to the elastic part 32 due to the clamping of the projection 32*c* of the elastic part 32 between the housing part 31*a* of the bearing part 31 to maintain the contact between the elastic part 32 and the housing part 31*a* under pressure.

The elastic part securing section 39 is secured to the elastic part supporting section 38 by fastening the securing pieces 38*d*, 39*c* with bolts 42*a*, 42*b* (or other suitable fasteners), and fastening the securing pieces 38*e*, 39*d* with bolts 42*c*, 42*d* (or other suitable fasteners). Accordingly, the elastic part 32 is preferably press-fitted about the impeller shaft 26, circumferentially as well as longitudinally. Therefore, the boundaries between the elastic part 32 and the bearing part 31, between the elastic part 32 and the elastic part supporting section 38, and between the elastic part 32 and the elastic part securing section 39 are maintained in a substantially sealed condition.

The elastic part 32 provided on the outer peripheral surface 31*a* of the bearing part 31 thus is secured (e.g. clamped) between the elastic part supporting section 38 and the elastic part securing section 39. Thus, the production cost can be reduced and the installation work is eased. Reduced production costs are attained in comparison with the process in which the elastic part and the bearing part supporting section are secured by baking, for instance, as has been done in the prior art.

A sealing member 43 that is preferably made of rubber is mounted about the outer peripheral surfaces of the cylindrical body 37 and the cylindrical projection 31*b* of the bearing part 31. In the illustrated embodiment, the sealing member 43 has a generally cylindrical shape; however, the sealing member 43 can have other suitable shapes, e.g., a bellow. Tightening belts 44*a*, 44*b* are fastened around the outer peripheral surface of the sealing member 43 at portions corresponding to the cylindrical body 37 and the cylindrical projection 31*b*, respectively. The belts 44*a*, 44*b* are preferably fastened with bolts 45*a* and 45*b*, respectively; however, other suitable fasteners can be used. Accordingly, the boundary between the cylindrical body 37 and the cylindrical projection 31*b* is maintained in a substantially sealed condition. This results in a driveshaft supporting structure 30 that is simply structured in comparison to the prior art yet has a substantial sealing ability.

Thus, in the illustrated embodiment, the cylindrical body 37 extends from the base 36, which is secured to the duct wall 27, toward the inner section of the watercraft body while covering the outer peripheral surface of the driveshaft 26. The main body of the elastic part supporting section is formed at the end of the cylindrical body 37, and the elastic part 32is secured by the main body of the elastic part supporting section 38 and the elastic part securing section 39. Thus, the elastic part supporting section can be provided proximal the outer peripheral surface of the driveshaft, reducing the space needed to mount the elastic part supporting section. This also provides flexibility in the layout design of other components of the watercraft.

During operation of the watercraft 10, even when water enters through an opening 27*c* formed in the duct wall 27, through which the impeller shaft 26 passes, the driveshaft supporting structure 30 inhibits water from entering the engine chamber 14 through the cylindrical body 37 and the cylindrical projection 31*b*. Additionally, the bearing part 31 and the elastic part 32 can vibrate against the elastic part supporting section 38. Thus, the bearing part 31 can vibrate along with the vibration that may occur on the impeller shaft 26, maintaining the substantially sealed condition at the boundary between the impeller shaft 26 and the bearing part 31.

An oil tank 46 is preferably disposed at the rear of the engine 17 to supply lubricating oil to the engine 17. The lubricating oil supplied from the oil tank 46 substantially prevents the malfunction of the engine 17 (e.g., engine seizures) and allows the engine 17 to operate generally smoothly. The jet propulsion watercraft 10 also preferably has cooling water passages to cool the aforementioned systems. Besides the aforementioned systems, the jet propulsion watercraft 10 can have other devices, such as an electrical equipment box that accommodates an electronic control unit including a CPU, a ROM, a RAM, and a timer, and various electrical equipment, a start switch, various types of sensors.

To operate the jet propulsion watercraft 10 described above, the start switch is first turned on to start the engine. As an operator operates the steering handlebars 12 and a throttle controller provided on the grip of the steering handlebars 12, the jet propulsion watercraft 10 runs in a desired direction at a desired speed.

As the watercraft 10 operates, outside air is drawn into the air intake box 18*e* via the air ducts 23*a*, 23*b*. The air is directed to each intake pipe 18*a* after passing through the devices of the intake system 18 described above. In the intake pipe 18*a*, the air is mixed with fuel provided from the fuel tank 16 via the fuel pump, and the mixture is subsequently delivered through each intake pipe 18*a* to the corresponding cylinder column 17*c*. The air-fuel mixture combusts within the cylinder column 17*c* as it is ignited by the ignition system, to drive the engine 17. The rotational force of the crankshaft obtained by the driving force of the engine 17 is transmitted to the impeller shaft 26, which drives the propulsion unit 22.

The combustion gas generated within the cylinder columns 17*c* as a result of the combustion of the air-fuel mixture is directed into the casing 11*c* of the propulsion unit 22 through the exhaust system 19, and discharged out of the watercraft. The aforementioned systems are cooled via the cooling water passages composed of hoses, to prevent excessive heating. Thus, each system is maintained in substantially proper condition during operation of the watercraft 10. Water, which is drawn into the propulsion unit 22 through the water inlet 28, is used as cooling water. Entrance of foreign matters into the propulsion unit 22 is prevented by the pipes 28*a*.

During operation of the watercraft 10, the impeller shaft 26 rotates while supported by the driveshaft supporting mechanism 30. The inner section and the outer section of the body 11 are separated in a substantially sealed condition, along with the impeller shaft 26, with the duct wall 27 interposed therebetween. Any vibration on the impeller shaft 26 is substantially absorbed by the elastic part 32. Thus, the driving force is transmitted appropriately from the impeller shaft 26 to the propulsion unit 22 without permitting water to substantially intrude into the engine chamber 14.

As described above, in the jet propulsion watercraft 10 according to this embodiment, the bearing part supporting section 33 is secured to the duct wall 27, and the elastic part supporting section 38 and the elastic part securing section 39 that compose the bearing part supporting section 33 bring the elastic part 32 into press contact with the bearing part 31 attached on the impeller shaft 26. Thus, any vibration on the impeller shaft 26 is substantially absorbed by the elastic part 32, and the rotational force of the impeller shaft 26 is transmitted to the propulsion unit 22. In addition, because the elastic part supporting section 38 and the elastic part securing section 39 are secured by the bolt 42*a*, or other suitable fasteners, the assembly of the elastic part supporting section 38 and elastic part securing section 39 is simplified.

As illustrated in FIGS. 4–5, the cylindrical body 37 projects forward from the base 36 of the bearing part supporting section 33 while covering the impeller shaft 26. The boundary between the cylindrical body 37 and the cylindrical projection 31*b* of the bearing part 31 is substantially sealed by the sealing member 43. In this manner, the inner section and the outer section of the body 11 are separated in a substantially sealed condition with the duct wall 27 interposed therebetween. In addition, since the cylindrical body 37 is provided proximal the impeller shaft 26, the driveshaft supporting mechanism 30 can be made compact, requiring less space for attaching the driveshaft supporting mechanism 30. Consequently, additional parts can be installed or the parts layout can be designed flexibly.

The press-contact surface 39*b* is preferably located at the front end of the elastic part securing section 39 for allowing the elastic part 32 to be press-fitted with the rear side of the elastic part securing section 39. This allows the elastic part 32 to be more reliably press-fitted with the rear side of the elastic part securing section 39, resulting in a more reliable seal. In another embodiment, additional elasticity and sealing ability can be attained by providing additional holes 32*a* of adequate shape. The elastic part 32 is secured with its projection 32*c* clamped between the bearing part 31 and the press-contact surface 39*b*. Thus, the elastic part 32 is maintained in a substantially fixed condition because the possibility of the occurrence of positional displacement is low.

Figure 6:
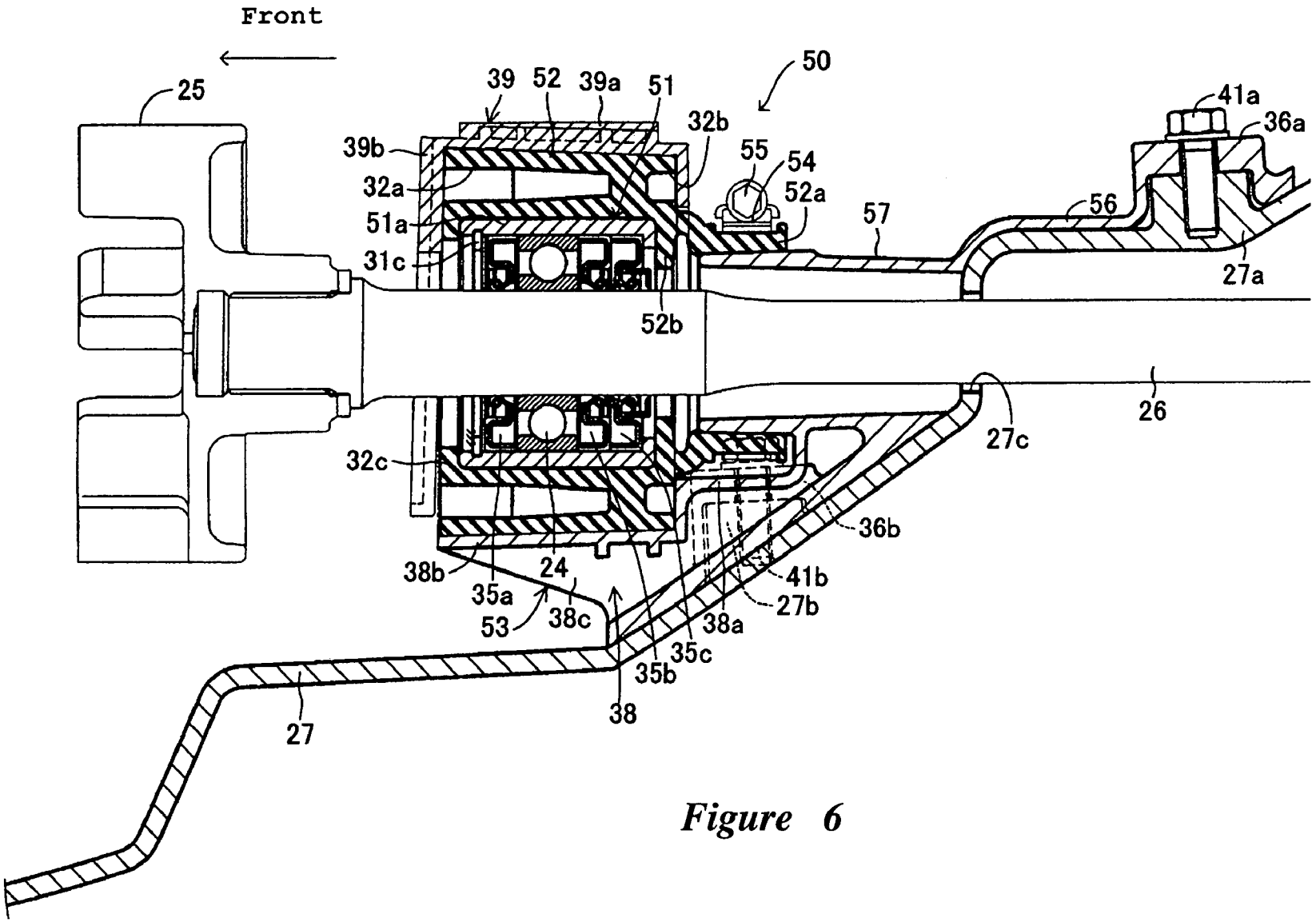
FIG. 6 is a cross-sectional view of a driveshaft supporting mechanism according to a second embodiment.

FIG. 6 shows a driveshaft supporting mechanism 50 according to a second embodiment. In the driveshaft supporting mechanism 50, the outer shell of the bearing part 51 has a cylindrical housing part 51*a*, without a cylindrical projection provided on the aforementioned bearing part 31. A cylindrical projection 52*a* having a generally smaller diameter and extending rearward of the elastic part 52 is provided at the rear end of the elastic part 52. Preferably, a ring-shaped projection 52*b* that extends inward is formed on the inner peripheral surface at the front end of the cylindrical projection 52*a*.

The cylindrical projection 52*a* preferably covers the outer peripheral surface of the cylindrical body 57 extending forward from the base 56 of the bearing part supporting section 53. The cylindrical projection 52*a* is preferably secured with a tightening belt 54 and a bolt 55 about the outer periphery of the cylindrical projection 52*a*. Other parts of the driveshaft supporting mechanism 50 are identical with those of the aforementioned driveshaft supporting mechanism 30. Therefore, such corresponding parts are denoted with the identical reference numerals.

Constructed in accordance with the second embodiment of the driveshaft supporting mechanism 50, a cylindrical projection is not required and one each of tightening belt 54 and bolt 55 can be used. This allows downsizing of the driveshaft supporting mechanism 50 and facilitates the assembly and mounting work. Cost reduction can also be achieved because the number of parts used is reduced. Other functions and effects of the driveshaft supporting mechanism 50 are identical with those of the driveshaft supporting mechanism 30 in the aforementioned embodiment.

Figure 7:
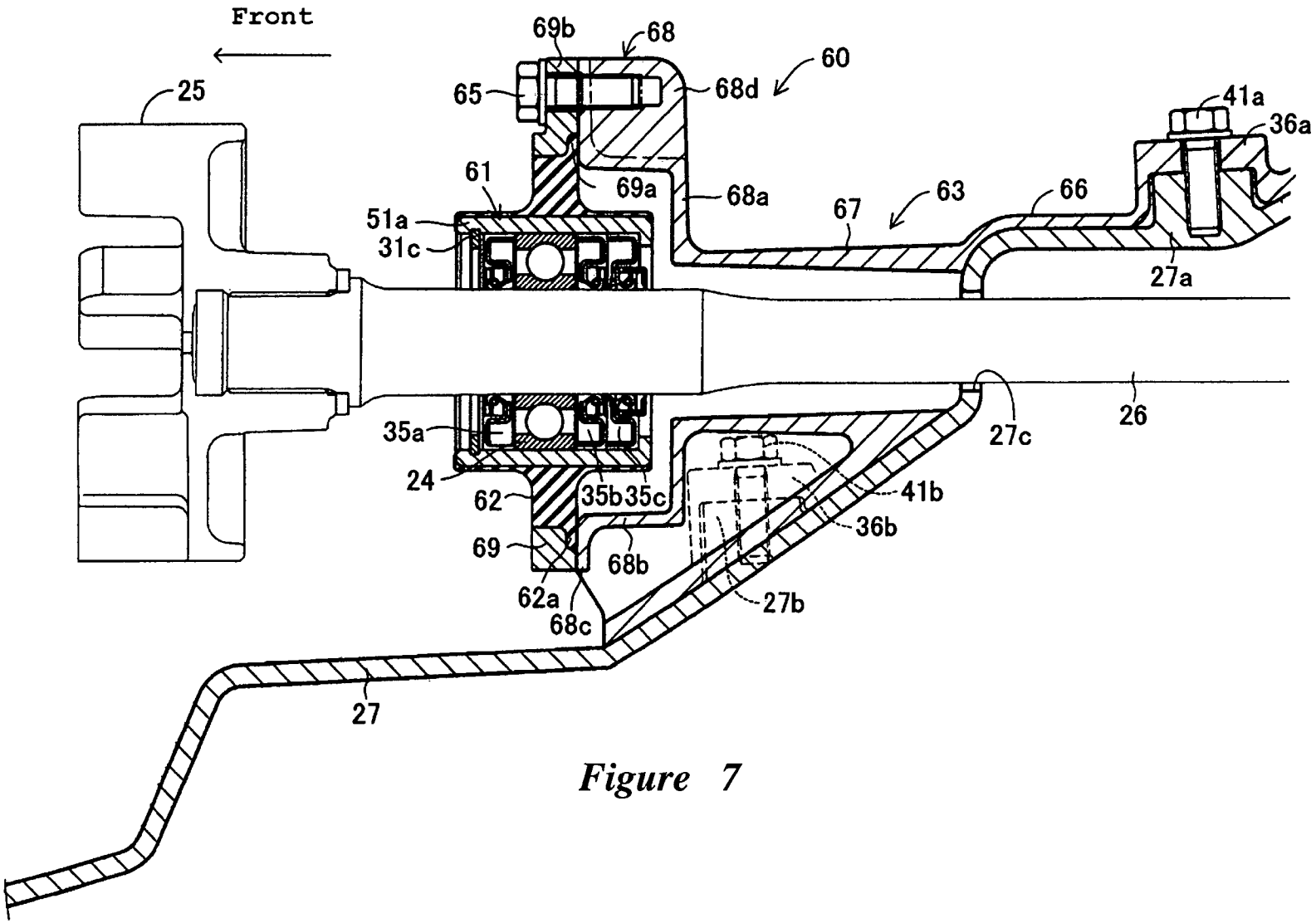
FIG. 7 is a cross-sectional view of a driveshaft supporting mechanism according to a third embodiment.

FIG. 7 shows a driveshaft supporting mechanism 60 according to a third embodiment. In the driveshaft supporting mechanism 60, the bearing part supporting section 63 has a base 66, a cylindrical body 67 projecting forward from the base 66, a supporting part body 68 projecting forward from the front end of the cylindrical body 67, and a generally ring-shaped mounting part 69 attached to the supporting part body 68 with a bolt 65.

The supporting part body 68 preferably has a rear face 68*a* extending outward from the edge of the front end of the cylindrical body 67, a cylindrical portion 68*b* extending forward from the outer peripheral edge of the rear face 68*a*, and a flange 68*c* expanding outward from the front end of the cylindrical portion 68*b*. Three securing parts 68*d* (only one of which is shown) provided with a bolt hole are formed at regular intervals along the circumference of the outer peripheral surface of the cylindrical portion 68*b*.

In the illustrated embodiment, the mounting part 69 has a generally ring-shaped body with a circumferential groove 69*a* along the inner circumference on the rear face of the mounting part 69, and has securing parts 69*b* corresponding to the securing parts 68*d* of the supporting part body 68. The mounting part 69 is assembled to the supporting part body 68 by securing the securing parts 68*d* to the securing parts 69*b* by the bolts 65 (or other suitable fasteners).

The elastic part 62 attached on the outer peripheral surface of the bearing part 61 is preferably generally ring shaped and has a protrusion 62*a* extending outward along the outer peripheral edge of the rear face of the elastic part 62. The bearing part 61 is generally composed of the same parts of the bearing part 51 shown in FIG. 6. The elastic part 62 is preferably secured on the outer peripheral surface of the bearing part 61 via baking. The elastic part 62 is press-fitted with and secured on the inner peripheral surface of the mounting part 69, with the protrusion 62*a* of the elastic part 62 extending into the groove 69*a* of the mounting part 69 and clamped between the supporting part body 68 and the mounting part 69. A substantially watertight seal is established by the press contact between the protrusion 62*a* and the groove 69*a*, and the press contact between the outer peripheral surface of the elastic part 62 and the inner peripheral surface of the mounting part 69. Other parts of the driveshaft supporting mechanism 60 are identical with those of the aforementioned driveshaft supporting mechanism 50. Therefore, the corresponding parts are denoted with the identical reference numerals.

Constructed in accordance with the third embodiment of the driveshaft supporting mechanism 50, a more compact arrangement is possible for the driveshaft supporting mechanism 60. In addition, the number of parts used is reduced substantially. For example, because the tightening belts and bolts to fasten the belts are not required, further facilitating the installation work necessary. Other functions and effects of the driveshaft supporting mechanism 60 are identical with those of the driveshaft supporting mechanisms 30 and 50 in the aforementioned embodiments.

Figure 8:
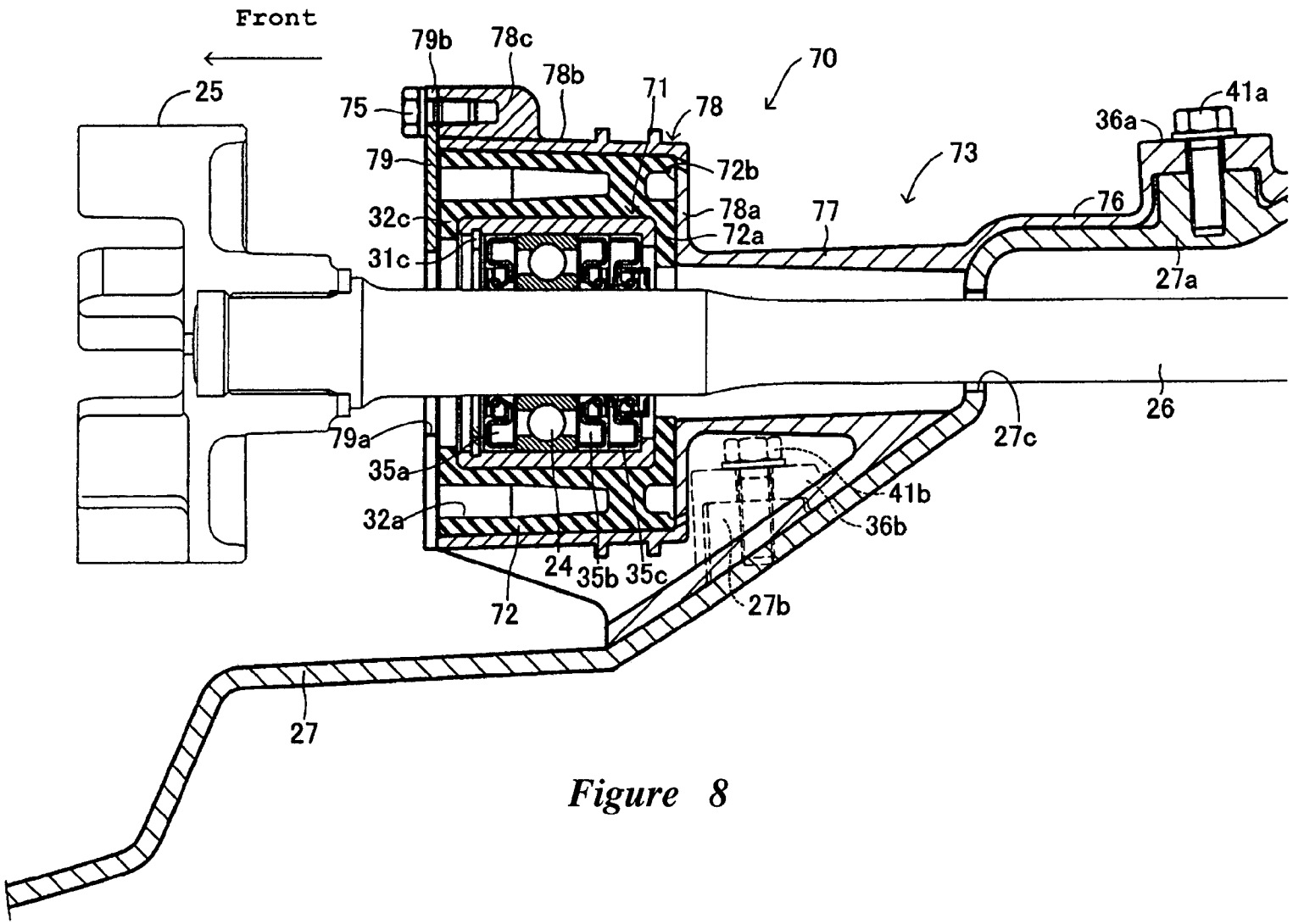
FIG. 8 is a cross-sectional view of a driveshaft supporting mechanism according to a fourth embodiment.

FIG. 8 shows a driveshaft supporting mechanism 70 according to a fourth embodiment. In the driveshaft supporting mechanism 70, the bearing part supporting section 73 has a base 76, a generally cylindrical body 77 projecting forward from the base 76, an annular part 78 projecting forward from the front end of the cylindrical body 77, and a press-contact surface 79 attached to the annular part 78 with a bolt 75.

In the illustrated embodiment, the annular part 78 has a rear face 78*a* extending outward from the edge of the front end of the cylindrical body 77, and a cylindrical portion 78*b* extending forward from the outer peripheral edge of the rear face 78*a*. Three securing parts 78*c* (only one of which is shown in FIG. 8), each provided with a bolt hole, are formed at regular intervals along the circumference of the outer peripheral surface of the cylindrical portion 78*b*. The press-contact surface 79 is preferably a generally circular plate with an insertion hole 79*a* preferably at its center, and is formed with securing parts 79*b* at portions corresponding to the securing parts 78*c* of the annular part 78. The press-contact surface 79 is assembled to the annular part 78 by securing the securing parts 78*c* to the securing parts 79*b* by the bolts 75.

The elastic part 72 attached on the outer peripheral surface of the bearing part 71 is formed in the shape of the elastic part 32 shown in FIG. 3, further formed with a ring-shaped projection 72*a* extending inward at the inner peripheral edge at the rear end, and a ring-shaped small projection 72*b* extending rearward at the outer peripheral edge at the rear end. The projection 72*a* is clamped between the rear end face of the bearing part 71 and the rear face 78*a* of the annular part 78. The small projection 72*b* is press-fitted with the rear face 78*a* to be crushed. A substantially watertight seal is established by the small projection 72*b*. The bearing part 71 has the identical structure with the bearing part 51 shown in FIG. 6. Other parts of the driveshaft supporting mechanism 70 are identical with those in the aforementioned driveshaft supporting mechanism 50. Therefore, the corresponding parts are denoted with the identical reference numerals.

Constructed in accordance with the fourth embodiment of the driveshaft supporting mechanism 70, the driveshaft supporting mechanism 70 has simplified structure, and assembly work is facilitated as well. Also, the structure is generally robust, and the elastic part 72 is adequately press-fitted . Other functions and effects of the driveshaft supporting mechanism 70 are substantially identical with those of the aforementioned embodiments. The driveshaft supporting mechanism for a jet propulsion watercraft according to any of the embodiments disclosed herein is not limited to the aforementioned embodiments, but it may be altered for implementation within the technical scope of this invention.

As understood from the above description, the present driveshaft supporting structure is particularly well suited for use with jet propulsion watercraft, for example personal watercraft and jet boats; however, the driveshaft supporting structure also can be used with other types of watercraft propulsion systems, for example, with an inboard-outboard drive. The present structure requires small space for installation and requires less work for installation and removal, meaning that assembly and repair costs can be reduced.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or sub-combinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A driveshaft supporting structure for a watercraft for supporting in a substantially watertight manner at least a portion of a driveshaft that extends from an engine disposed within an inner section of a hull of the watercraft to a propulsion unit disposed outside the inner section of the hull, the driveshaft supporting structure comprising a bearing part mounted about a peripheral surface of the driveshaft at a location within the inner section of the hull, an elastic part mounted on a peripheral surface of the bearing part, and a bearing part supporting section supporting the elastic part press-fitted with the bearing part, the bearing part supporting section being attached to a wall of the hull at a location where the driveshaft extends from the inner section of the hull, the bearing part supporting section further comprising a base secured to the wall with the driveshaft passing therethrough, an elastic part supporting section extending forward from the base to support the elastic part, and an elastic part securing section for securing the elastic part by clamping the elastic part between the elastic part securing section and the elastic part supporting section.

2. The driveshaft supporting structure of claim 1 additionally comprising a sleeve that covers an outer peripheral surface of the driveshaft rearward from the base of the bearing part.

3. The driveshaft supporting structure of claim 2, wherein a rear end of the elastic part projects from the elastic part securing section to extend toward the sleeve, and a boundary between the rear end of the elastic part and the sleeve is substantially sealed.

4. The driveshaft supporting structure of claim 2, wherein a rear end of the bearing part projects from the elastic part securing section to extend toward the sleeve, and a boundary between the rear end of the bearing part and the sleeve is substantially sealed with a sealing member.

5. The driveshaft supporting structure of claim 4, wherein a press-fit surface is provided at a front end of the elastic part securing section to allow the elastic part to be press-fitted with a rear side thereof.

6. The driveshaft supporting structure of claim 5, wherein the elastic part supporting section and the elastic part securing section of the bearing part supporting section are fastened with a bolt.

7. The driveshaft supporting structure of claim 6, wherein a front end of the elastic part is positioned at a front end surface of the bearing part, and the front end of the elastic part is secured by the front end surface of the bearing part and the press-fit surface.

8. A driveshaft supporting structure for a watercraft for supporting in a substantially watertight manner at least a portion of a driveshaft that extends from an engine disposed within an inner section of a hull of the watercraft to a propulsion unit disposed outside the inner section of the hull, the driveshaft supporting structure comprising a bearing part mounted about a peripheral surface of the driveshaft at a location within the inner section of the hull, an elastic part mounted on a peripheral surface of the bearing part, and a bearing part supporting section supporting the elastic part press-fitted with the bearing part, the bearing part supporting section being attached to a wall of the hull at a location where the driveshaft extends from the inner section of the hull, the bearing part supporting section further comprising a ring-shaped mounting part surrounding an outer peripheral surface of the elastic part to support the elastic part, and a supporting part body secured to the wall to support a side surface of the mounting part, and wherein the elastic part is secured by clamping a portion thereof between the mounting part and the supporting part body.

9. A watercraft comprising a hull, an engine disposed within the hull, a propulsion device carried by the hull with at least one wall of the hull disposed between the engine and the propulsion device, a driveshaft extending between the engine and the propulsion device so as to transfer power from the engine to the propulsion device, the driveshaft extending through the wall of the hull, and a driveshaft supporting device attached to the wall, the driveshaft supporting device comprising a bearing part mounted about a peripheral surface of the driveshaft and disposed on an engine-side of the wall, an elastic part mounted on a peripheral surface of the bearing part and extending beyond a least one end of the bearing part, and a bearing part supporting section supporting the elastic part press-fitted with the bearing part, the bearing part supporting section being attached to the wall at a location where the driveshaft extends therethrough, the bearing part supporting section further comprising a base secured to the wall with the driveshaft passing therethrough, an elastic part supporting section extending forward from the base to support the elastic part, and an elastic part securing section for securing the elastic part by clamping the elastic part between the elastic part securing section and the elastic part supporting section.

10. A watercraft comprising a hull, an engine disposed within the hull, a propulsion device carried by the hull with at least one wall of the hull disposed between the engine and the propulsion device, a driveshaft extending between the engine and the propulsion device so as to transfer power from the engine to the propulsion device, the driveshaft extending through the wall of the hull, and a driveshaft supporting device attached to the wall, the driveshaft supporting device comprising a bearing part mounted about a peripheral surface of the driveshaft and disposed on an engine-side of the wall, an elastic part mounted on a peripheral surface of the bearing part and extending beyond a least one end of the bearing part, and a bearing part supporting section supporting the elastic part press-fitted with the bearing part, the bearing part supporting section being attached to the wall at a location where the driveshaft extends therethrough, the propulsion device comprising a pump and the wall defining a portion of a duct through which water flows into the pump, wherein a press-fit surface is provided at a front end of the elastic part securing section to allow the elastic part to be press-fitted with a rear side thereof and wherein the elastic part supporting section and the elastic part securing section of the bearing part supporting section are fastened with a bolt.

11. A watercraft comprising a hull, an engine disposed within the hull, a propulsion device carried by the hull with at least one wall of the hull disposed between the engine and the propulsion device, a driveshaft extending between the engine and the propulsion device so as to transfer power from the engine to the propulsion device, the driveshaft extending through the wall of the hull, and a driveshaft supporting device attached to the wall, the driveshaft supporting device comprising a bearing part mounted about a peripheral surface of the driveshaft and disposed on an engine-side of the wall, an elastic part mounted on a peripheral surface of the bearing part and extending beyond a least one end of the bearing part, and a bearing part supporting section supporting the elastic part press-fitted with the bearing part, the bearing part supporting section being attached to the wall at a location where the driveshaft extends therethrough, the propulsion device comprising a pump and the wall defining a portion of a duct through which water flows into the pump, wherein a press-fit surface is provided at a front end of the elastic part securing section to allow the elastic part to be press-fitted with a rear side thereof and wherein a front end of the elastic part is positioned at a front end surface of the bearing part, and the front end of the elastic part is secured by the front end surface of the bearing part and the press-fit surface.

12. A watercraft comprising a hull, an engine disposed within the hull, a propulsion device carried by the hull with at least one wall of the hull disposed between the engine and the propulsion device, a driveshaft extending between the engine and the propulsion device so as to transfer power from the engine to the propulsion device, the driveshaft extending through the wall of the hull, and a driveshaft supporting device attached to the wall, the driveshaft supporting device comprising a bearing part mounted about a peripheral surface of the driveshaft and disposed on an engine-side of the wall, an elastic part mounted on a peripheral surface of the bearing part and extending beyond a least one end of the bearing part, and a bearing part supporting section supporting the elastic part press-fitted with the bearing part, the bearing part supporting section being attached to the wall at a location where the driveshaft extends therethrough, wherein the bearing part supporting section comprises a ring-shaped mounting part surrounding an outer peripheral surface of the elastic part to support the elastic part, and a supporting part body secured to the wall to support a side surface of the mounting part, and wherein the elastic part is secured by clamping a portion thereof between the mounting part and the supporting part body.

* * * * *

UNITED STATES PATENT AND TRADEMARK OFFICE

CERTIFICATE OF CORRECTION

PATENT NO. : 7,198,531 B2
APPLICATION NO. : 10/972761
DATED : April 3, 2007
INVENTOR(S) : Mitsuyoshi Nakamura et al.

It is certified that error appears in the above-identified patent and that said Letters Patent is hereby corrected as shown below:

In column 2 (Other Publications) at line 3, Delete "Manuel," and insert -- Manual, --, therefor.

In column 6 at line 11, Delete "stem" and insert -- stern --, therefor.

In column 6 at line 31, Delete "stem" and insert -- stern --, therefor.

In column 6 at line 35, Delete "stem" and insert -- stern --, therefor.

Signed and Sealed this

Seventh Day of August, 2007

JON W. DUDAS
*Director of the United States Patent and Trademark Office*